US007588020B2

(12) United States Patent
Yasuhara

(10) Patent No.: US 7,588,020 B2
(45) Date of Patent: Sep. 15, 2009

(54) OIL SEPARATOR

(75) Inventor: Shigeki Yasuhara, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/430,866

(22) Filed: May 10, 2006

(65) Prior Publication Data

US 2006/0254566 A1 Nov. 16, 2006

(30) Foreign Application Priority Data

May 10, 2005 (JP) ..... 2005-137726

(51) Int. Cl.
*F01M 13/04* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 3,834,365 | A * | 9/1974 | Ussery | 123/573 |
| 4,993,375 | A * | 2/1991 | Akihiko | 123/90.38 |
| 5,417,184 | A * | 5/1995 | McDowell | 123/41.86 |
| 5,450,835 | A * | 9/1995 | Wagner | 123/573 |
| 5,479,907 | A * | 1/1996 | Walker, Jr. | 123/573 |
| 6,058,917 | A * | 5/2000 | Knowles | 123/573 |
| 6,422,224 | B1 * | 7/2002 | Walker, Jr. | 123/572 |
| 6,460,524 | B2 * | 10/2002 | Kimura | 123/572 |
| 6,591,820 | B2 | 7/2003 | Kitano et al. | |
| 6,994,078 | B2 * | 2/2006 | Roberts et al. | 123/572 |
| 7,007,682 | B2 * | 3/2006 | Takahashi et al. | 123/572 |

FOREIGN PATENT DOCUMENTS

| | | |
|---|---|---|
| DE | 102 35 983 | 3/2003 |
| EP | 0 287 756 A2 | 10/1988 |
| JP | 3-172 524 A | 7/1991 |
| JP | 07-259530 | 10/1995 |
| JP | 9-08-8544 | 3/1997 |
| JP | 9-09-6209 | 4/1997 |
| JP | 10-026 012 A | 1/1998 |
| KR | 1000365201 B1 | 12/2002 |

OTHER PUBLICATIONS

German language version of German Office Action, Appln. No. 10 2006 021 605.9 -13 dated Nov. 8, 2007.
English translation of German Office Action, Appln. No. 10 2006 021 605.9 -13 dated Nov. 8, 2007.

* cited by examiner

*Primary Examiner*—M. McMahon
(74) *Attorney, Agent, or Firm*—Kenyon & Kenyon LLP

(57) ABSTRACT

A casing of an oil separator has an inlet port through which blow-by gas flows into the oil separator, and an outlet port through which the blow-by gas flows out of the oil separator. The casing defines a blow-by gas passage the extends to connect the inlet port to the outlet port. A separation mechanism is located in the blow-by gas passage. The separation mechanism traps oil in blow-by gas, thereby separating the oil from the blow-by gas. A drain port is formed in the casing to drain the separated oil. The outlet port is located in one of opposite side portions of the casing. The drain port is located in the other one of the opposite side portions of the casing. The oil separator is capable of reliably suppressing repeated splash of the separated oil.

21 Claims, 4 Drawing Sheets

OIL SEPARATOR

BACKGROUND OF THE INVENTION

The present invention relates to an oil separator that separates oil contained in blow-by gas of an engine.

Conventionally, blow-by gas returning devices are known that return blow-by gas, which leaks out from combustion chambers of an engine to a crankcase, to an intake passage, thereby ventilating the crankcase. Blow-by gas contains oil mist. When the oil mist collects on the inner surface of the intake passage, foreign matter contained in intake air adheres to the oil mist, which may cause formation of deposit. Accordingly, oil separators have been proposed that separates and recovers oil mist in blow-by gas. For example, an oil separator disclosed in Japanese Laid-Open Patent Publication No. 9-88544 blows blow-by gas that has flowed into the oil separator through an inlet port on a plurality of diverting plates located in a blow-by gas passage, thereby recovering oil mist on the diverting plates through a drain port. On the other hand, the oil separator allows the blow-by gas, from which oil mist has been separated, to flow from an outlet port to an intake passage.

In the oil separator of the above publication, oil mist on the diverting plates is guided to the drain port while the blow-by gas is diverted along a blow-by gas passage. Therefore, the direction along which the oil mist is guided and the direction along which the blow-by gas flows intersect with each other, which may splash the oil mist anew. Such repeated splashing of oil mist reduces the recovery rate of oil mist. As a result, blow-by gas containing a considerable amount of oil mist is returned to the intake passage.

SUMMARY OF THE INVENTION

Accordingly, it is an objective of the present invention to provide an oil separator capable of preventing oil that has been separated from blow-by gas from being repeatedly splashed.

To achieve the foregoing objective, one aspect of the present invention provides an oil separator for separating oil contained in blow-by gas from the blow-by-gas. The oil separator includes a casing, a separation mechanism, and a drain port. The casing has an inlet port through which blow-by gas flows into the oil separator, and an outlet port through which the blow-by gas flows out of the oil separator. The casing defines a blow-by gas passage extending to connect the inlet port and the outlet port to each other. The separation mechanism is located in the blow-by gas passage. The separation mechanism traps oil in blow-by gas, thereby separating the oil from the blow-by gas. The drain port is formed in the casing, and drains the separated oil. The outlet port is located in one of side portions of the casing that are located in opposite ends. The drain port is located in the other one of the side portions.

Another aspect of the present invention provides an oil separator for separating oil contained in blow-by gas from the blow-by gas. The separator includes a casing, a separation mechanism, and a drain port. The casing has an inlet port through which blow-by gas flows into the oil separator, and an outlet port through which the blow-by gas flows out of the oil separator. The casing defines a blow-by gas passage extending to connect the inlet port and the outlet port to each other. The separation mechanism is located in the blow-by gas passage. The separation mechanism traps oil in blow-by gas, thereby separating the oil from the blow-by gas. The drain port is formed in the casing, and drains the separated oil. The drain port opens in a direction opposite to a direction of flow of blow-by gas from the separation mechanism toward the outlet port.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A blow-by gas returning device according to one embodiment of the present invention will now be described with reference to FIGS. 1 to 3.

Figure 1:
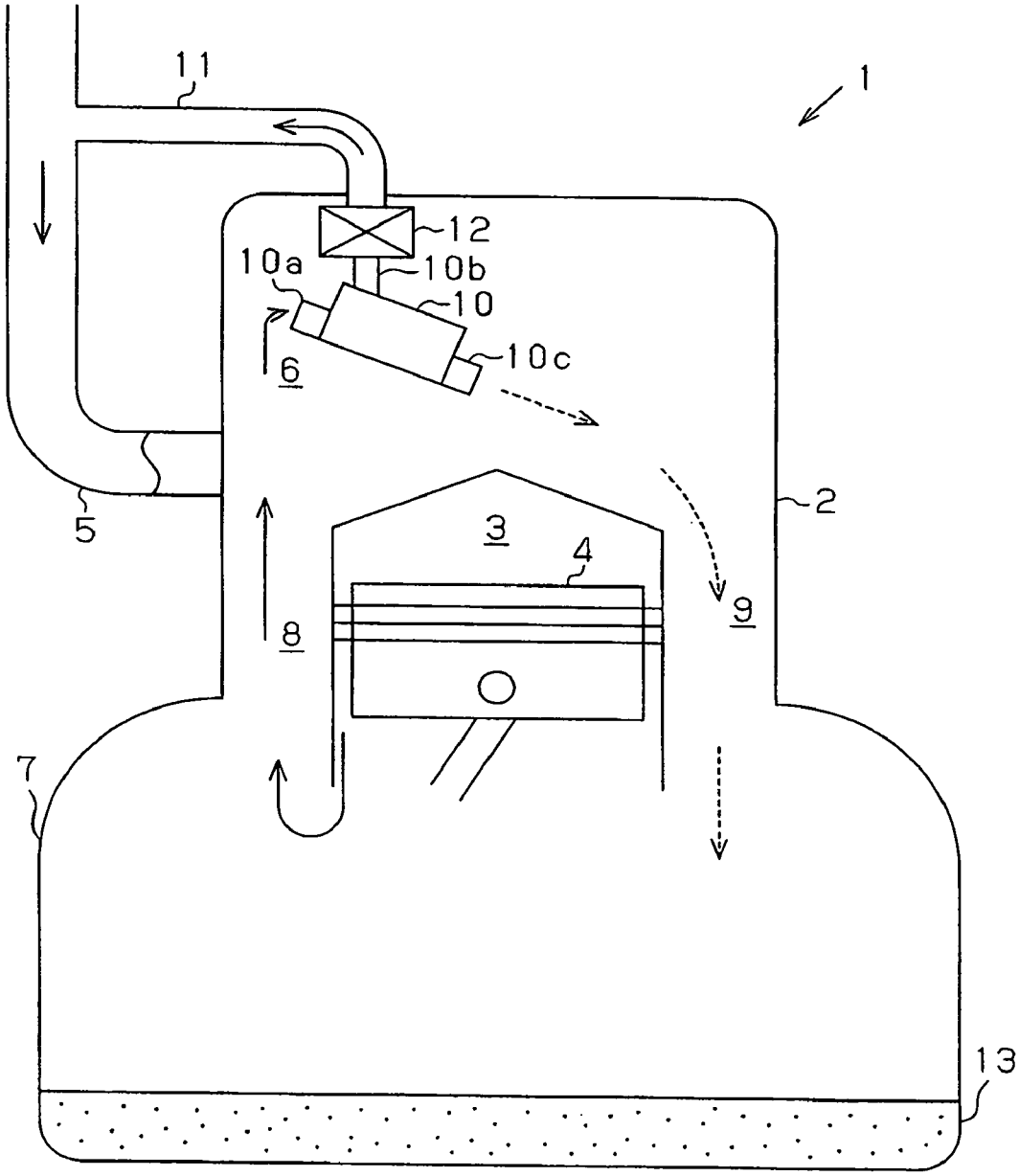
FIG. 1 is a diagrammatic view illustrating an engine having a blow-by gas returning device according to one embodiment of the present invention.

FIG. 1 illustrates an engine 1 having the blow-by gas returning device. A main body 2 of the engine 1 has a plurality of cylinders 3 (only one is shown). A piston 4 is located in each cylinder 3 to reciprocate. An intake manifold (intake passage) 5 is connected to the engine main body 2. The interior of the intake manifold 5 communicates with the interior of the cylinders 3, or combustion chambers. A valve chamber 6 is defined in an upper portion of the engine main body 2. The valve chamber 6 accommodates a camshaft (not shown), which actuates intake valves and exhaust valves. The engine main body 2 includes a crankcase 7 located below the cylinders 3. The engine main body 2 also includes a first guide passage 8 and a second guide passage 9 that connect the crankcase 7 with the valve chamber 6.

In the engine main body 2, an oil separator 10 is located above the valve chamber 6. The oil separator 10 has an inlet port 10*a* that communicates with the valve chamber 6. The oil separator 10 also has an outlet port 10*b* and a drain port 10*c*. The oil separator 10 traps oil mist contained in blow-by gas flowing in through the inlet port 10*a*, and discharges the purified blow-by gas (blow-by gas from which oil mist is removed) through the outlet port 10*b*. The oil separator 10 drains the oil mist trapped in the oil separator 10 through the drain port 10*c*. The outlet port 10*b* and the intake manifold 5 are connected to each other by a pipe 11. A PCV valve 12, which is an electromagnetic valve, is located in the pipe 11. The PCV valve 12 is opened and closed, thereby connecting and disconnecting the outlet port 10*b* and the intake manifold 5 with respect to each other.

Next, the flow of blow-by gas will be described. When, during the operation of the engine 1, the internal pressure of the intake manifold 5 becomes a negative pressure and the PCV valve 12 is opened, blow-by gas that leaks through a space between the piston 4 and the inner wall of the cylinder 3 is guided to the inlet port 10*a* of the oil separator 10 via the crankcase 7, the first guide passage 8, and the valve chamber 6 as illustrated by arrows of solid lines in FIG. 1.

The blow-by gas that has flowed into the oil separator 10 through the inlet port 10*a* is purified because oil mist contained in the blow-by gas is trapped by the oil separator 10. The purified blow-by gas flows out through the outlet port 10*b*, and is guided the intake manifold 5 through the pipe 11. Unburned fuel contained in the blow-by gas that has flowed into the intake manifold 5 is drawn into the cylinder 3 and burned.

On the other hand, the oil mist trapped in the oil separator 10 is drained through the drain port 10*c* as shown by arrows of dotted lines in FIG. 1, and reaches an oil pan 13 located below the crankcase 7 via the second guide passage 9 and the crankcase 7. The interior of the crankcase 7 communicates with the atmosphere through an unillustrated passage.

The internal structure of the oil separator 10 will now be described with reference to FIGS. 2 to 3B. The oil separator 10 includes a casing 21, which is provided with the inlet port 10*a*, the outlet port 10*b*, and the drain port 10*c*.

The casing 21 has side portions located at opposite ends. The inlet port 10*a* and the outlet port 10*b* are located in one of the side portions (the left side portion as viewed in FIG. 2). The drain port 10*c* is located in the other one of the side portions (the right side portion as viewed in FIG. 2). A blow-by gas passage 22 is defined in the interior of the casing 21 by a dividing portion 21*a*. The blow-by gas passage 22 is U-shaped as a whole and includes through passage sections (first to third passage sections) 23, 24, and 25. The inlet port 10*a* and the outlet port 10*b* are connected to each other by the blow-by gas passage 22. The drain port 10*c* is formed in the casing 21 to be located at a turned section of the blow-by gas passage 22. The drain port 10*c* opens in a different direction (substantially, opposite direction) from the opening direction of the outlet port 10*b* (see FIG. 3B). In other words, the drain port 10*c* opens in a different direction (substantially, opposite direction) from a direction in which blow-by gas flows out the outlet port 10*b*.

A separation mechanism 30 is located in the blow-by gas passage 22, specifically, between the first passage section 23 and the second passage section 24. The separation mechanism 30 traps oil mist in blow-by gas, and drains the oil mist through the drain port 10*c*. The separation mechanism 30 includes a restriction plate 31 having a plurality of holes 31*a*, and a trapping plate 32 for trapping oil mist in blow-by gas, and a backflow prevention plate 33 that prevents oil from flowing back from the drain port 10*c*. The drain port 10*c* is also a component of the separation mechanism 30.

Figure 2:
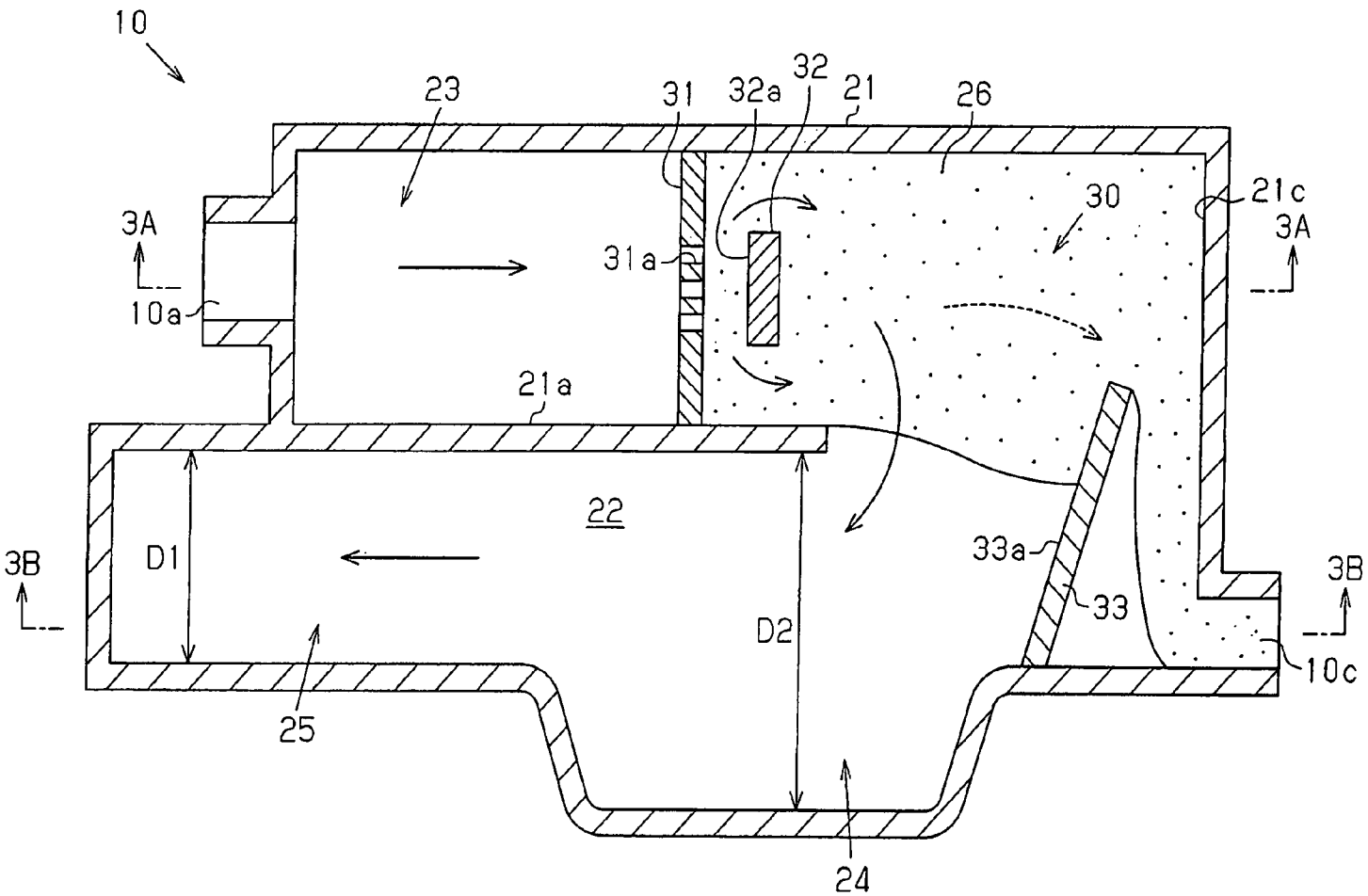
FIG. 2 is a cross-sectional view illustrating the oil separator provided in the blow-by gas returning device shown in FIG. 1.
Figure 3A:
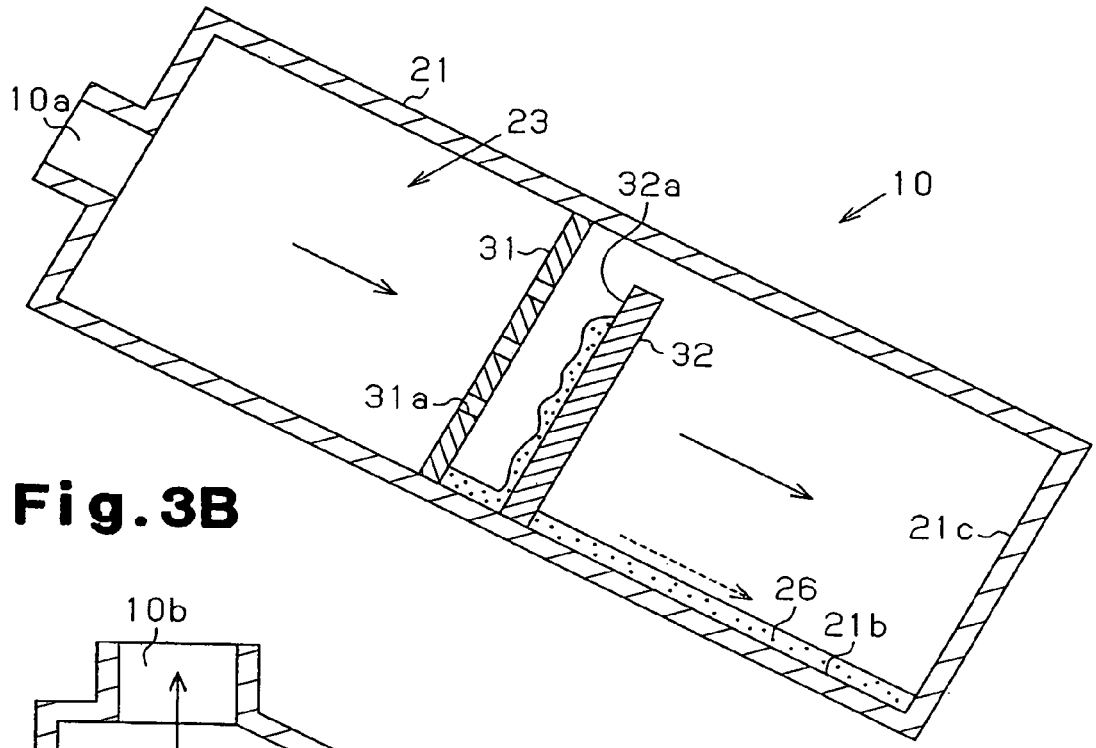
FIG. 3A is a cross-sectional view taken along line 3A-3A of FIG. 2.
Figure 3B:
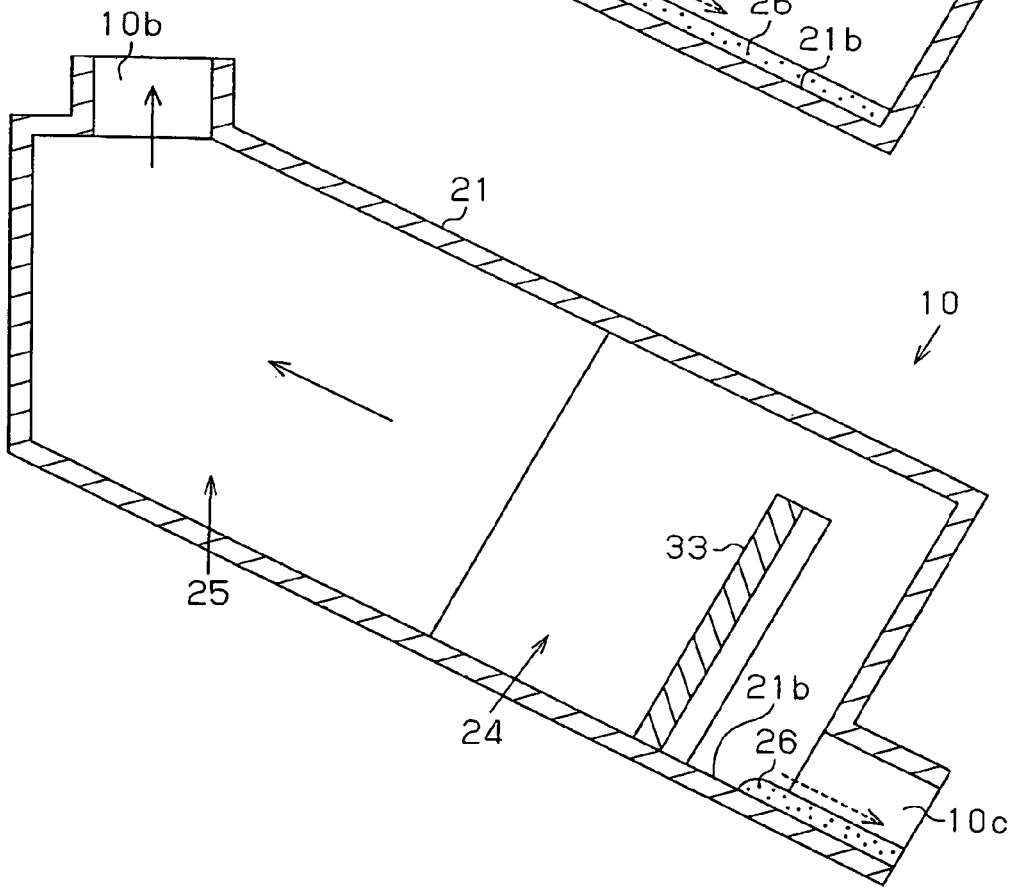
FIG. 3B is a cross-sectional view taken along line 3B-3B of FIG. 2.

As shown in FIGS. 3A and 3B, the casing 21 is inclined such that the inlet port 10*a* and the outlet port 10*b* are located higher than the drain port 10*c*. The third passage section 25 of the blow-by gas passage 22 is located downstream of the separation mechanism 30, and higher than the separation mechanism 30. On the other hand, the second passage section 24 of the blow-by gas passage 22, which is located upstream of the third passage section 25, is located lower than the restriction plate 31 and the trapping plate 32 of the separation mechanism 30. In a horizontal cross-section shown in FIG. 2, the width D1 of the third passage section 25 is less than the width D2 of the second passage section 24. That is, the cross-sectional area of the third passage section 25 is smaller than the cross-sectional area of the second passage section 24. The outlet port 10*b* is located in an upper surface of the casing 21, and opens upward so that blow-by gas flows out upward along a vertical direction (see FIG. 3B).

Next, the flow of blow-by gas and the flow of oil mist in the oil separator 10 will be described. During the operation of engine 1, when the internal pressure of the intake manifold 5 becomes a negative pressure and the PCV valve 12 is open, blow-by gas flows into the casing 21 through the inlet port 10*a*, and flows out through the outlet port 10*b*.

The flow of blow-by gas in the casing 21 is shown by arrows of solid lines in FIGS. 2 to 3B. Blow-by gas containing oil mist flows into the first passage section 23 of the blow-by gas passage 22 from the inlet port 10*a*, and the flow is restricted by the holes 31*a* of the restriction plate 31. That is, by passing through the holes 31*a*, the flow velocity of the blow-by gas is increased. The blow-by gas with an increased flow velocity collides against the trapping plate 32, so that some of the oil mist contained in the blow-by gas collects on the trapping plate 32 and condenses. On the other hand, the blow-by gas, from which some of the oil mist has been separated, turns around as shown by an arrow of solid lines in FIG. 2 after passing by the trapping plate 32. The oil mist that remains in the blow-by gas has a relatively great mass, and its direction of flow cannot be easily changed due to the inertia. Therefore, when the blow-by gas turns around, the oil mist in the blow-by gas collides against a wall surface 21*c* of the casing 21 having the drain port 10*c* and a wall surface 33*a* of the backflow prevention plate 33, and collects on the wall surfaces 21*c*, 33*a*. The blow-by gas, from which oil mist has been further removed by the wall surfaces 21*c*, 33*a*, passes through the second passage section 24 and reaches the third passage section 25. Since the cross-sectional area of the third passage section 25 is smaller than the cross-sectional area of the second passage section 24, the flow velocity of blow-by gas is increased in the third passage section 25. The blow-by gas then flows upward out of the outlet port 10*b*.

The flow of oil mist collected on the trapping plate 32 shown by arrows of broken lines in FIGS. 2 to 3A. The oil mist collected on the trapping plate 32 condenses to form liquid oil 26, and flows down on a front surface 32*a* of the trapping plate 32 and reaches a bottom surface 21*b* of the casing 21. After reaching the bottom surface 21*b*, the oil 26 is guided to the drain port 10*c* after streaming on the bottom surface 21*b*, which is inclined relative to a horizontal plane. The oil mist collected on the wall surface 21*c* of the casing 21 and the wall surface 33*a* of the backflow prevention plate 33 flows down to the bottom surface 21*b* of the casing 21, and is guided to the drain port 10*c* after streaming on the bottom surface 21*b*. The oil 26, which has been guided to the drain port 10*c*, is recovered to the oil pan 13 from the drain port 10*c* via the second guide passage 9.

In the oil separator 10 configured as described above, the draining direction of the oil mist and the discharging direction of the blow-by gas are significantly different from each other, and the oil mist separated from the blow-by gas by the separation mechanism 30 is prevented from being raised and repeatedly splashed by the flow of the blow-by gas. In a portion where blow-by gas contacts the oil 26 spread on the bottom surface 21*b* of the casing 21, the oil 26 is possibly raised and repeatedly splashed by the flow of the blow-by gas. Therefore, the second passage section 24, which is adjacent to and downstream of the separation mechanism 30, preferably has a relatively large cross-sectional area so that the flow velocity is reduced in the second passage section 24. On the other hand, in the third passage section 25, which is located above the separation mechanism 30, the oil 26 hardly exists on the bottom surface 21*b* of the casing 21. Thus, even if the cross-sectional area of the third passage section 25 is relatively reduced to increase the flow velocity of the blow-by gas, the oil 26 is unlikely to be repeatedly splashed.

The above described embodiment provides the following advantages.

(1) The outlet port 10*b* is located in one of the opposite side portions of the casing 21. The drain port 10*c* is located in the other one of the opposite side portions of the casing 21. The drain port 10*c* opens in a direction opposite to the direction of flow of blow-by gas from the separation mechanism 30 toward the outlet port 10*b*. The blow-by gas from which oil is separated by the trapping plate 32 is guided to the outlet port 10*b*, and oil mist collected on the trapping plate 32 is guided to the drain port 10*c* located in a side opposite to the side of the outlet port 10*b*. Therefore, the draining direction of oil mist and the discharging direction of blow-by gas are greatly different from each other. Therefore, the blow-by gas is prevented from contacting the oil 26 spread on the bottom surface 21*b* of the casing 21. Accordingly, oil mist is prevented from raised and repeatedly splashed by the flow of the blow-by gas.

(2) The outlet port 10*b* and the drain port 10*c*, which are located in the opposite side portions of the casing 21, are separated from each other by a great distance. Therefore, oil accumulated in the drain port 10*c* is suppressed from flowing out from the outlet port 10*b* as much as possible.

(3) The drain port 10*c* opens in a direction opposite to the second and third passage sections 24, 25, through which blow-by gas flows after oil mist has been removed therefrom. Therefore, the draining direction of oil mist and the discharging direction of blow-by gas can be significantly different from each other. This prevents oil mist from raised and repeatedly splashed by the flow of blow-by gas.

(4) The inlet port 10*a* and the outlet port 10*b* are located in the same side portion of the casing 21 so that the blow-by gas passage 22 has a U-shape. The drain port 10*c* is provided in the casing 21 to be located at the turned section of the blow-by gas passage 22. When blow-by gas turns around, oil mist contained the blow-by gas collides against the wall surface 21*c* of the casing 21 and the wall surface 33*a* of the backflow prevention plate 33 located at the turned section of the blow-by gas passage 22, and is readily guided to the drain port 10*c*. Therefore, oil mist is reliably separated from blow-by gas with a relatively compact structure.

(5) The drain port 10*c* is located in the turned section of the U-shaped blow-by gas passage 22. Therefore, the oil 26 accumulated in the turned section of the blow-by gas passage 22 is efficiently drained from the drain port 10*c*.

(6) The outlet port 10*b* is located in the upper surface of the casing 21, and opens upward so that blow-by gas flows out upward along a vertical direction. Oil mist contained in blow-by gas has a relatively large mass, and therefore does not easily flow vertically upward due to the action of gravity. Therefore, oil mist is suppressed from flowing out through the outlet port 10*b* as much as possible.

(7) The cross-sectional area of the third passage section 25, which is located downstream of and higher than the separation mechanism 30, is smaller than the cross-sectional area of the second passage section 24, which is located lower than the restriction plate 31 and the trapping plate 32 of the separation mechanism 30. In the third passage section 25, the oil 26 hardly exists on the bottom surface 21*b* of the casing 21. Thus, even if the cross-sectional area of the third passage section 25 is relatively reduced to increase the flow velocity of the blow-by gas, the oil 26 is unlikely to be repeatedly splashed. Therefore, the size of the oil separator is reduced by reducing the cross-sectional area of the third passage section 25, while suppression the repeated splash of oil.

The above illustrated embodiment may be modified as follows.

Figure 4:
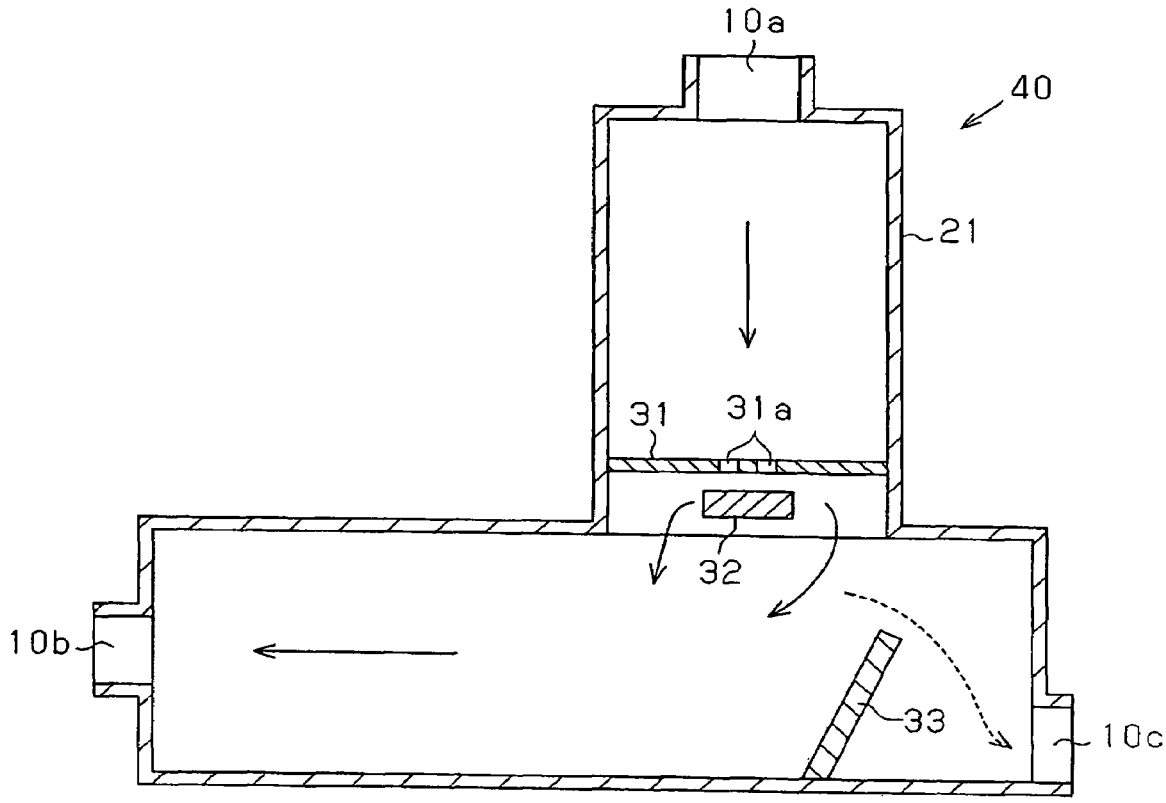
FIG. 4 is a cross-sectional view illustrating an oil separator according to another embodiment of the present invention.

In the embodiment of FIGS. 1 to 3B, the blow-by gas passage 22 is U-shaped. However, the blow-by gas passage 22 may have a different shape. For example, in an oil separator 40 shown in FIG. 4, an L-shaped blow-by gas passage is formed in the casing 21. The oil separator 40 separates oil mist in blow-by gas that has flowed in through the inlet port 10*a* by means of the trapping plate 32, and guides the purified blow-by gas to the outlet port 10*b* located in a side portion of the casing 21 (see arrows of solid lines). On the other hand, the separated oil mist is guided to the drain port 10*c*, which is located in port 10*b* (see arrow of broken line). This configuration also greatly differentiates the draining direction of oil mist and discharging direction of blow-by gas from each other, and suppresses repeated splash of oil mist.

In the embodiment of FIGS. 1 to 3B, the drain port 10*c* is located in the turned section of the U-shaped blow-by gas passage 22, and opens in a direction opposite to the second and third passage sections 24, 25. However, the drain port 10*c* may be located downstream of or upstream of the turned section of the blow-by gas passage 22, and may open in an arbitrary direction.

In the embodiment of FIGS. 1 to 3B, the outlet port 10*b* is located in the upper surface of the casing 21, and opens upward. However, the outlet port 10*b* may be located in a surface other than the upper surface of the casing 21, and open in a direction other than an upward direction.

In the illustrated embodiments, the casing 21 is inclined such that the inlet port 10*a* and the outlet port 10*b* are located higher than the drain port 10*c*. However, the casing 21 does not need to be inclined, and the inlet port 10*a* and the outlet port 10*b* may be located at the same height as or lower than the drain port 10*c*.

In the embodiment of FIGS. 1 to 3B, the cross-sectional area of the third passage section 25, which is located downstream of and higher than the separation mechanism 30, is smaller than the cross-sectional area of the second passage section 24, which is located lower than the third passage section 25. However, if there is no possibility of repeated splash of oil mist, the cross-sectional area of the second passage section 24 may be reduced such that the cross-sectional area of the second passage section 24 is equal to the cross-sectional area of the third passage section 25.

In the illustrated embodiments, the single trapping plate 32 is used. However, two or more trapping plates 32 may be provided. The trapping plate 32 does not need to be shaped as a plate, but may have a different shape as long as it traps oil mist.

In the illustrated embodiments, the restriction plate 31 and the trapping plate 32 are located upstream of the turned section of the blow-by gas passage. However, the restriction plate 31 and the trapping plate 32 may be located downstream of the turned section.

Therefore, the present examples and embodiments are to be considered as illustrative and not restrictive and the invention is not to be limited to the details given herein, but may be modified within the scope and equivalence of the appended claims.

The invention claimed is:

1. An oil separator for separating oil contained in blow-by gas from the blow-by gas, the oil separator comprising:

a casing having an inlet port through which blow-by gas flows into the oil separator, and an outlet port through which the blow-by gas flows out of the oil separator, the casing defining a blow-by gas passage extending to connect the inlet port and the outlet port to each other, wherein the outlet port is formed to pass through a wall of the casing and the blow-by gas passage is surrounded by the wall of the casing;

a separation mechanism located in the blow-by gas passage, the separation mechanism trapping oil in blow-by gas, wherein the separating mechanism includes a trapping plate, the trapping plate being configured to allow the blow-by gas flowing in the blow-by gas passage to collide against the trapping plate, thereby separating the oil from the blow-by gas; and a drain port formed in the casing, the drain port draining the separated oil, the outlet port being located in one of side portions of the casing that are located in opposite ends, and the drain port being located in the other one of the side portions, wherein the blow-by gas passage includes a first passage section located upstream of the separation mechanism, a second passage section located downstream of the separation mechanism, and a third passage section located downstream of the second passage section and between the second passage section and the outlet port, wherein the oil separator is provided in a blow-by gas returning device and is arranged such that the third passage section is located higher than the separation mechanism and the second passage section, and wherein the third passage section has a smaller cross-sectional area than the second passage section and a larger cross-sectional area than the outlet port, wherein the blow-by gas passages has a turned section, the second passage section being located downstream of the turned section.

2. The oil separator according to claim 1, wherein the drain port opens in a direction opposite to a direction of flow of blow-by gas from the separation mechanism toward the outlet port.

3. The oil separator according to claim 1, wherein the inlet port and the outlet port are located in the same side of the casing such that the blow-by gas passages is U-shaped.

4. The oil separator according to claim 3, wherein the drain port is provided in the casing to be located at the turned section of the blow-by gas passage.

5. The oil separator according to claim 4, wherein the trapping plate is located upstream of the turned section with respect to a direction of flow of blow-by gas.

6. The oil separator according to claim 1, wherein the oil separator is arranged such that blow-by gas flows upward out of the outlet port.

7. The oil separator according to claim 1, wherein the oil separator is arranged such that the outlet port opens upward.

8. The oil separator according to claim 1, wherein the oil separator is arranged in an inclined state such that the outlet port is located higher than the drain port.

9. The oil separator according to claim 1, wherein the trapping plate is located upstream of the drain port with respect to a direction of flow of blow-by gas.

10. The oil separator according to claim 1, wherein the drain port is located at the turned section, and the second passage section is located above the drain port.

11. The oil separator according to claim 1, wherein the trapping plate extends into the blow-by gas passage from an inner surface of the casing.

12. An oil separator for separating oil contained in blow-by gas from the blow-by gas, the separator comprising:

a casing having an inlet port through which blow-by gas flows into the oil separator, and an outlet port through which the blow-by gas flows out of the oil separator, the casing defining a blow-by gas passage extending to connect the inlet port and the outlet port to each other wherein the outlet port is formed to pass through a wall of the casing and the blow-by gas passage is surrounded by the wall of the casing;

a separation mechanism located in the blow-by gas passage, the separation mechanism trapping oil in blow-by gas, wherein the separating mechanism includes a trapping plate, the trapping plate being configured to allow the blow-by gas flowing in the blow-by gas passage to collide against the trapping plate, thereby separating the oil from the blow-by gas; and a drain port formed in the casing, the drain port draining the separated oil, the drain port opening in a direction opposite to a direction of flow of blow-by gas from the separation mechanism toward the outlet port, wherein the blow-by gas passage includes a first passage section located upstream of the separation mechanism, a second passage section located downstream of the separation mechanism, and a third passage section located downstream of the second passage section and between the second passage section and the outlet port, wherein the oil separator is provided in a blow-by gas returning device and is arranged such that the third passage section is located higher than the separation mechanism and the second passage section, and wherein the third passage section has a smaller cross-sectional area than the second passage section and a larger cross-sectional area than the outlet port, wherein the blow-by gas passages has a turned section, the second passage section being located downstream of the turned section.

13. The oil separator according to claim 12, wherein the inlet port and the outlet port are located in the same side of the casing such that the blow-by gas passages is U-shaped.

14. The oil separator according to claim 13, wherein the drain port is provided in the casing to be located at the turned section of the blow-by gas passage.

15. The oil separator according to claim 14, wherein the trapping plate is located upstream of the turned section with respect to a direction of flow of blow-by gas.

16. The oil separator according to claim 12, wherein the oil separator is arranged such that blow-by gas flows upward out of the outlet port.

17. The oil separator according to claim 12, wherein the oil separator is arranged such that the outlet port opens upward.

18. The oil separator according to claim 12, wherein the oil separator is arranged in an inclined state such that the outlet port is located higher than the drain port.

19. The oil separator according to claim 12, wherein the trapping plate is located upstream of the drain port with respect to a direction of flow of blow-by gas.

20. The oil separator according to claim 12, wherein the drain port is located at the turned section, and the second passage section is located above the drain port.

21. The oil separator according to claim 12, wherein the trapping plate extends into the blow-by gas passage from an inner surface of the casing.

* * * * *

UNITED STATES PATENT AND TRADEMARK OFFICE

CERTIFICATE OF CORRECTION

PATENT NO. : 7,588,020 B2
APPLICATION NO. : 11/430866
DATED : September 15, 2009
INVENTOR(S) : Shigeki Yasuhara et al.

It is certified that error appears in the above-identified patent and that said Letters Patent is hereby corrected as shown below:

In the Title Page: In the Abstract, line 4, change "the extends" to --that extends--.

| Column | Line | |
|---|---|---|
| 3 | 7 | After "guided" insert --by--. |
| 5 | 15 | After "from" insert --being--. |
| 5 | 27 | Before "raised" insert --being--. |
| 5 | 34 | Change "contained" to --containing--. |
| 5 | 63 | Change "suppression" to --suppressing--. |
| 7 | 26 | Change "has" to --have--. |
| 7 | 35 | Change "is" to --are--. |
| 8 | 31 | Change "has" to --have--. |
| 8 | 36 | Change "is" to --are--. |

Signed and Sealed this

Eighteenth Day of May, 2010

David J. Kappos

David J. Kappos
*Director of the United States Patent and Trademark Office*